US010407886B2

(12) United States Patent
Ding et al.

(10) Patent No.: US 10,407,886 B2
(45) Date of Patent: Sep. 10, 2019

(54) PORTABLE SLOT WATER-INJECTION TOILET

(71) Applicant: QINGDAO CHUANGHUI INDUSTRY CO., LTD., Qingdao (CN)

(72) Inventors: Limin Ding, Qingdao (CN); Jinghe Wang, Qingdao (CN); Jinning Ding, Qingdao (CN); Guifen Bai, Qingdao (CN)

(73) Assignee: QINGDAO CHUANGHUI INDUSTRY CO., LTD., Qingdao (CN)

( * ) Notice: Subject to any disclaimer, the term of this patent is extended or adjusted under 35 U.S.C. 154(b) by 173 days.

(21) Appl. No.: 15/547,065

(22) PCT Filed: Nov. 6, 2015

(86) PCT No.: PCT/CN2015/093950
§ 371 (c)(1),
(2) Date: Jul. 27, 2017

(87) PCT Pub. No.: WO2017/049740
PCT Pub. Date: Mar. 30, 2017

(65) Prior Publication Data

US 2018/0002909 A1 Jan. 4, 2018

(30) Foreign Application Priority Data

Sep. 22, 2015 (CN) ..... 2015 1 0607034

(51) Int. Cl.
*E03D 5/01* (2006.01)
*E03D 7/00* (2006.01)
(Continued)

(52) U.S. Cl.
CPC ..... *E03D 5/01* (2013.01); *E03D 5/024* (2013.01); *E03D 5/09* (2013.01); *E03D 7/00* (2013.01);
(Continued)

(58) Field of Classification Search
CPC .. E03D 5/01; E03D 5/024; E03D 5/09; E03D 7/00; E03D 11/08; E03D 2201/40
(Continued)

(56) References Cited

U.S. PATENT DOCUMENTS 3,949,430 A * 4/1976 Miller ..... E03D 7/00 4/321
4,439,875 A * 4/1984 Stewart ..... E03D 5/012 4/321
(Continued)

FOREIGN PATENT DOCUMENTS

CN 103132592 A 6/2013
CN 103147499 A 6/2013
(Continued)

*Primary Examiner* — Tuan N Nguyen
(74) *Attorney, Agent, or Firm* — Gokalp Bayramoglu

(57) ABSTRACT

The present invention includes a toilet pool, wherein the toilet pool has a pool tapered from top to bottom, the bottom of the pool is a discharge outlet, the top of the pool is a tapered annular platform, the tapered annular platform consists of a wide part and a narrow part, above the tapered annular platform is a slot flush nozzle, shunts implemented by the slot flush nozzle are evenly distributed on a surface of the pool under the guide of the tapered annular platform, and the toilet pool is provided with a clean water supply. It achieves a configuration that two flushing systems coexist on a toilet pool, achieves secondary homogenization of water currents, achieves water-saving and efficient flushing, achieves maximization of water capacity in the same space, and achieves a simple, reliable fixedly-installed toilet.

11 Claims, 13 Drawing Sheets

(51) Int. Cl.
*E03D 5/02* (2006.01)
*E03D 5/09* (2006.01)
*E03D 11/08* (2006.01)

(52) U.S. Cl.
CPC ..... *E03D 11/08* (2013.01); *E03D 2201/40* (2013.01)

(58) Field of Classification Search
USPC ..... 4/249, 321, 328, 329, 332, 420, 422
See application file for complete search history.

(56) References Cited

U.S. PATENT DOCUMENTS 4,944,048 A * 7/1990 Sargent ..... E03D 5/01 4/323
5,557,810 A * 9/1996 Antos ..... E03D 5/01 4/321
5,875,499 A 3/1999 Hoffman et al.
7,725,961 B2 * 6/2010 Martinez ..... E03D 5/01 4/236

FOREIGN PATENT DOCUMENTS

CN 205205973 U 5/2016
WO WO2014170465 A1 10/2014

* cited by examiner

PORTABLE SLOT WATER-INJECTION TOILET

CROSS REFERENCE TO RELATED APPLICATIONS

This application is the national phase entry of International Application No. PCT/CN2015/093950, filed on Nov. 6, 2015, which is based upon and claims priority to Chienes Patent Application No. 201510607034.1, filed on Sep. 22, 2015, the entire contents of which are incorporated herein by reference.

TECHNICAL FIELD

The present invention relates to the technical field of sanitary wares, and particularly to a toilet with a manual pressurized piston pump and an electric pump which uses a slot nozzle to flush water.

BACKGROUND

Flushing toilets and portable flushing toilets are increasingly more in the market; one common flushing manner is a tubular single-head, double-head and horizontal spraying form, water sources are supplied through a telescopic pneumatic pump or a hand-lift water pump, and during operation, water can come out by waiting for recovery or reciprocating multiple times to form a negative pressure. Moreover, discharge pressure cannot be increased through artificial force; another one is electric flushing, an overall battery pack and a pump body take place of a manual pump body, coexistence of multiple forms cannot be achieved, power supply is battery powered, the source is single, and different demands of users cannot be met.

Further, a drain tank matching therewith cannot achieve intensification of space because the traditional rotary installed seal valve is installed outside the drain tank, another valve component is completely installed inside the drain tank, and damage of any component cannot enable replacement.

Further, fixing of the traditional drain tank is achieved through surrounding lugs or complicated components installed in the bottom, and the positioning is complex.

Further, a rotatable drain pipe that the traditional blow-molding drain tank is provided with cannot be completely poured out because a part of the drain pipe extends into the drain tank.

SUMMARY

The present invention aims at solving the above problems, and provides a portable slot water-injection toilet, which, on the one hand, achieves a configuration that two flushing systems coexist on a toilet pool, achieves secondary homogenization of water currents through a slot flush nozzle internally provided with choke shunt cones and a tapered annular water-current platform, to really achieve water-saving and efficient flushing, achieves maximization of water capacity in the same space through installation of a sunk seal ring and forming of an embedded-block edge buckle, to bring about efficiency and intensification to production, storage, use and other links, and achieves a simple, reliable fixedly-installed toilet through a long-slit locating slot blow-molded at the bottom of the drain tank. On the other hand, the pump body and the valve body of the present invention achieve the aim of easy use and convenient replacement and maintenance, prolong the overall service life, and save resources. A technical solution adopted is as follows:

A portable slot water-injection toilet, including: a toilet pool having a receiving cavity for receiving clean water, characterized in that: the toilet pool has a pool tapered from top to bottom, the bottom of the pool is a discharge outlet, the top of the pool is a tapered annular platform, the tapered annular platform consists of a wide part and a narrow part, above the tapered annular platform is a slot flush nozzle for shunting water currents, shunts implemented by the slot flush nozzle are evenly distributed on a surface of the pool under the guide of the tapered annular platform, and the toilet pool is further provided with a clean water supply means that can supply the clean water in the receiving cavity to the slot flush nozzle.

On the basis of the above technical solution, a first choke shunt cone and a second choke shunt cone that shunt water currents of a nozzle water inlet are formed on the slot flush nozzle, a part of a first shunt shunted by the first choke shunt cone flows from the wide part of the tapered annular platform to the narrow part of the tapered annular platform along a first transverse direction, and the other part flows down along a surface of the pool like a fan along a downward direction; a part of a second shunt shunted by the second choke shunt cone flows from the wide part of the tapered annular platform to the narrow part of the tapered annular platform along a second transverse direction, and the other part flows down along the surface of the pool like a fan along a downward direction; and the first transverse direction is opposite to the second transverse direction.

On the basis of the above technical solution, a third shunt cone is further formed on the slot flush nozzle, the third shunt cone is located between the first choke shunt cone and the second choke shunt cone to re-shunt downward water currents shunted by the first choke shunt cone and the second choke shunt cone, and shunts are divided into water currents in two inclined down directions: a first inclined direction and a second inclined direction.

On the basis of the above technical solution, the clean water supply means is a manual supply means or an electric supply means or an integration of a manual supply means and an electric supply means, the manual supply means includes: a first pipeline and a piston pressure pump, the piston pressure pump is installed onto the toilet pool, the piston pressure pump sucks up the clean water in the receiving cavity through a water inlet of the piston pressure pump and supplies clean water to the slot flush nozzle by means of the first pipeline connected with a water outlet of the piston pressure pump, and the water inlet is provided with a one-way inlet valve; and the electric supply means includes: a sinking pump for pumping out the clean water in the receiving cavity and a second pipeline, and the sinking pump supplies clean water to the slot flush nozzle by means of the second pipeline.

On the basis of the above technical solution, the manual supply means further includes a nut, a first groove is formed on the toilet pool, a first projection is formed in a corresponding position of the nut, the toilet pool and the nut are rotatably connected together through mutual snapping of the first groove and the first projection, external threads are formed on outer wall surfaces of a cylinder of the piston pressure pump, the cylinder is in a threaded connection with the nut, a first seal ring is disposed between the nut and the toilet pool, and a second seal ring is disposed between the cylinder and the nut.

On the basis of the above technical solution, the manual supply means further includes a first anti-loosening means for preventing the nut from loosening and a positioning means for preventing the cylinder from rotating, the first anti-loosening means is connected with the nut and the toilet pool, the positioning means mainly consists of a positioning wedge and a connecting arm, the positioning wedge is fixed with the cylinder through the connecting arm, a pit fitting the positioning wedge is formed on the toilet pool, and the positioning wedge penetrates the pit.

On the basis of the above technical solution, the toilet pool is provided with a filling port for making up water into the receiving cavity, the filling port is provided with a transitional connector having a cavity, a top outside face of the transitional connector is recessed downwards to form a filling channel for adding water, the filling channel is in communication with a top opening of the filling port and the receiving cavity, a filling port inner ring is formed on a top inside of the filling port, the transitional connector has a concave nip fitting the filling port inner ring, through matching positioning of the filling port inner ring and the concave nip, the transitional connector is detachably connected with the filling port, a water outlet joint of the sinking pump is connected with a water inlet end of the transitional connector, one end of the second pipeline is connected with a water outlet end of the transitional connector, the filling channel is not in communication with the cavity, and the water inlet end and the water outlet end of the transitional connector are in communication with the cavity.

On the basis of the above technical solution, the portable slot water-injection toilet further includes a drain tank for containing sewage, the top of the drain tank is installed with an embedded valve lock nut in a rotating connection with the drain tank and a threaded seal valve in a threaded connection with the embedded valve lock nut, the threaded seal valve is in communication with the discharge outlet, a second groove is formed on the drain tank, a second projection is formed in a corresponding position of the embedded valve lock nut, the embedded valve lock nut and the drain tank are snapped together through the second groove and the second projection, a third seal ring is disposed between the embedded valve lock nut and the drain tank, a fourth seal ring is disposed between the threaded seal valve and the embedded valve lock nut, a position where the drain tank joins the embedded valve lock nut is formed hollowly towards an inner cavity direction of the drain tank to cause the threaded seal valve to sink into the drain tank, and the drain tank is provided thereon with a fixed drain outlet and/or a drain pipe in a rotating connection with the drain tank.

On the basis of the above technical solution, a second anti-loosening means for preventing the embedded valve lock nut from loosening is disposed between the embedded valve lock nut and the drain tank.

On the basis of the above technical solution, a third groove is formed on the drain tank, a third projection is formed in a corresponding position on an outer wall side of the drain pipe, the drain pipe and the drain tank are snapped together through the third groove and the third projection, a fifth seal ring is disposed between the drain pipe and the drain tank, a part of the drain pipe extends into the drain tank, a slope structure is disposed in an inlet position near the drain pipe on an inner wall face of the drain tank, and the highest point of the slope structure is flush with an inlet of the drain pipe.

On the basis of the above technical solution, the bottom of the drain tank has a long-slit locating slot, and inside the long-slit locating slot is a clamping structure for clamping any sheet-like fixed plate or U-shaped reinforcing steel that can be inserted into the long-slit locating slot.

The present invention has the following advantages: the present invention, on the one hand, achieves a configuration that two flushing systems coexist on a toilet pool, achieves secondary homogenization of water currents through a slot flush nozzle internally provided with choke shunt cones and a tapered annular water-current platform, to really achieve water-saving and efficient flushing, achieves maximization of water capacity in the same space through installation of a sunk seal ring and forming of an embedded-block edge buckle, to bring about efficiency and intensification to production, storage, use and other links, and achieves a simple, reliable fixedly-installed toilet through a long-slit locating slot blow-molded at the bottom of the drain tank. On the other hand, the pump body and the valve body of the present invention achieve the aim of easy use and convenient replacement and maintenance, prolong the overall service life, and save resources. Compared with the related products in the current market, the present invention has strong generality, and related parts in the products in the current market can be transformed by using part of the structure of the present invention, to develop new generation of products and increase the use value thereof.

BRIEF DESCRIPTION OF THE DRAWINGS

To describe the technical solutions of the embodiments of the present invention or the existing technology more clearly, the following briefly introduces the accompanying drawings required for describing the embodiments or the existing technology. Apparently, the accompanying drawings in the following description show only some embodiments of the present invention, and a person of ordinary skill in the art may still derive other drawings from these accompanying drawings without creative efforts.

DETAILED DESCRIPTION OF THE INVENTION

Figure 1:
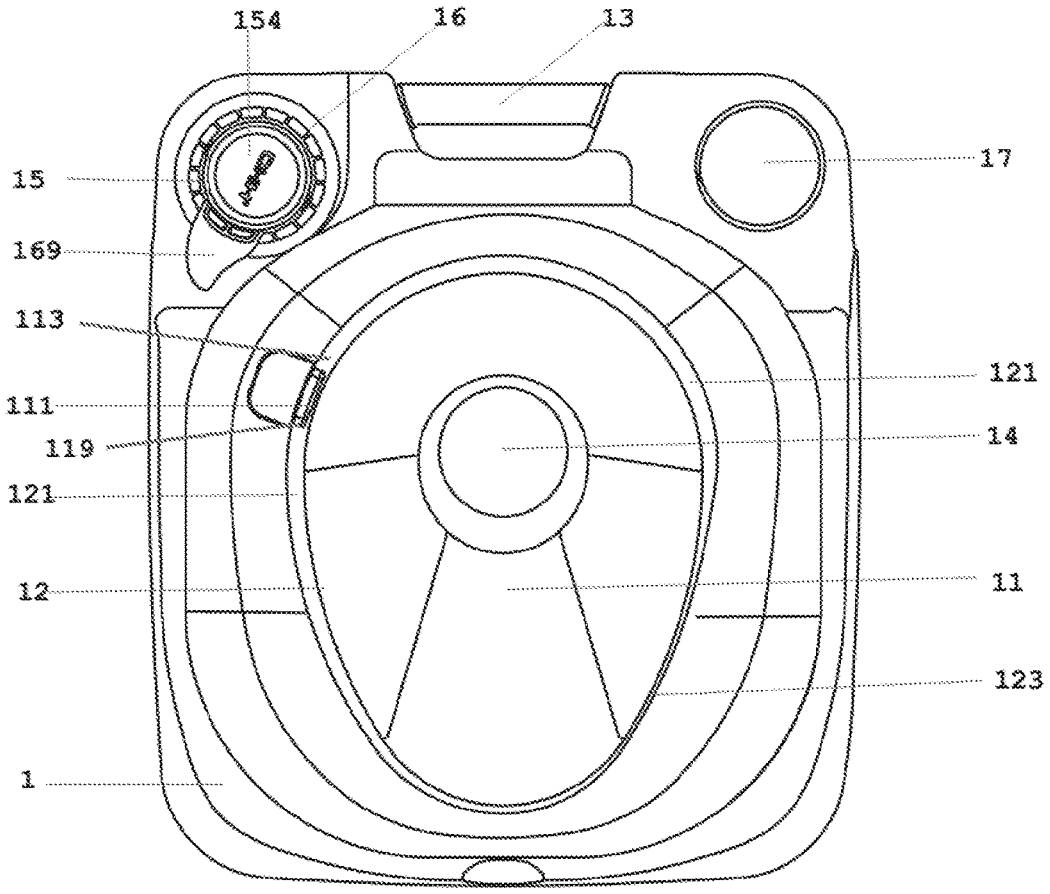
FIG. 1 is a top structural diagram of the toilet pool according to the present invention.

The present invention is further described below in combination with the accompanying drawings and examples.

Embodiments of the present invention are described below in detail, examples of the embodiments are illustrated in the drawings, and the same or similar reference signs from beginning to end represent the same or similar elements or elements having the same or similar functions. The embodiments described below with reference to the drawings are exemplary and are merely used to explain the present invention, but cannot be understood as limitations to the present invention.

In the description of the present invention, it should be understood that the terms "first", "second", "third", "fourth" and "fifth" are merely used for description, but cannot be understood as indicating or implying relative importance.

In the description of the present invention, it should be noted that, unless expressly specified and defined, the terms "install", "interconnect" and "connect" should be understood in a broad sense, for example, it may be a fixed connection, or a detachable connection, or an integrated connection; and may be connected directly, or be connected indirectly through a intermediate medium. For those of ordinary skill in the art, specific meanings of the terms in the present invention can be understood according to specific situations.

Figure 2:
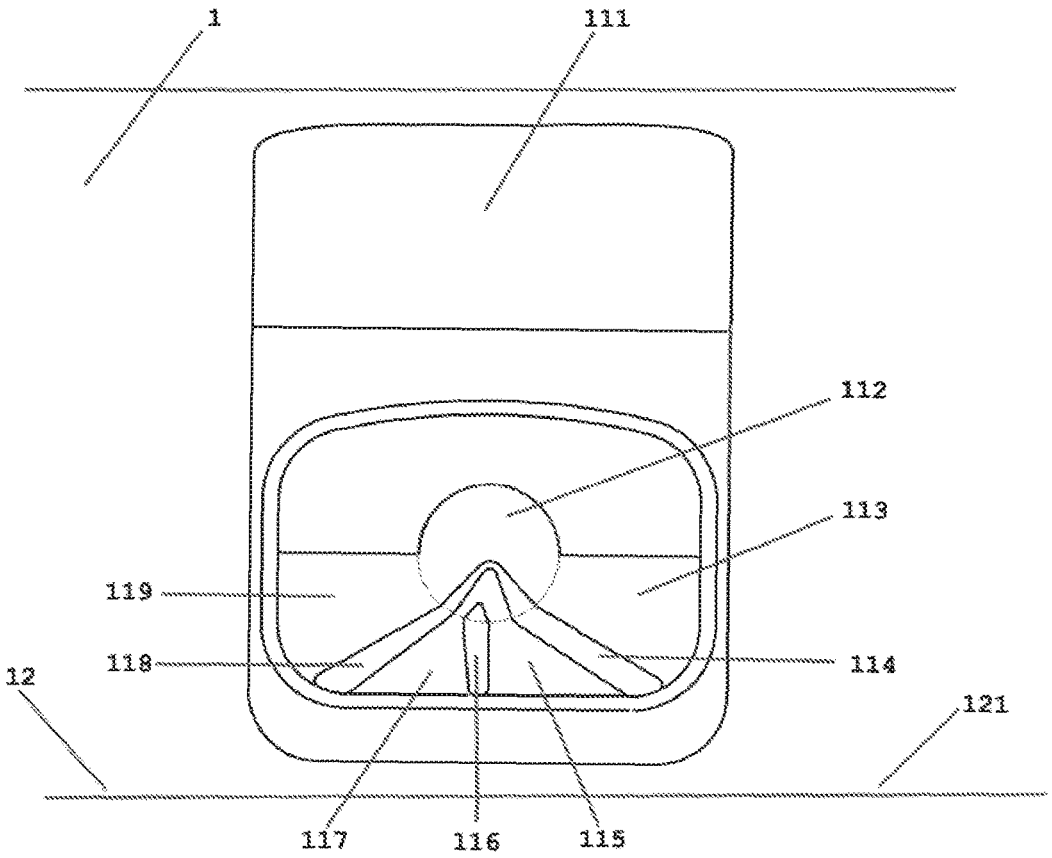
FIG. 2 is a structural diagram of the slot flush nozzle according to the present invention.

As shown in FIG. 1 and FIG. 2, a portable slot water-injection toilet, including: a toilet pool 1 having a receiving cavity 10 for receiving clean water, characterized in that: the toilet pool 1 has a pool 11 tapered from top to bottom, the bottom of the pool 11 is a discharge outlet 14, the top of the pool 11 is a tapered annular platform 12, the tapered annular platform 12 consists of a wide part 121 and a narrow part 123, above the tapered annular platform 12 is a slot flush nozzle 111 for shunting water currents, shunts implemented by the slot flush nozzle 111 are evenly distributed on a surface of the pool 11 under the guide of the tapered annular platform 12, and the toilet pool 1 is further provided with a clean water supply means that can supply the clean water in the receiving cavity 10 to the slot flush nozzle 111.

As shown in FIG. 2, preferably, a first choke shunt cone 118 and a second choke shunt cone 114 that shunt water currents of a nozzle water inlet 112 are formed on the slot flush nozzle 111, a part of a first shunt shunted by the first choke shunt cone 118 flows from the wide part 121 of the tapered annular platform 12 to the narrow part 123 of the tapered annular platform 12 along a first transverse direction 119, and the other part flows down along a surface of the pool 11 like a fan along a downward direction; a part of a second shunt shunted by the second choke shunt cone 114 flows from the wide part 121 of the tapered annular platform 12 to the narrow part 123 of the tapered annular platform 12 along a second transverse direction 113, and the other part flows down along the surface of the pool 11 like a fan along a downward direction; in this process, if the water flow rate of the water current flowing transversely along the tapered annular platform 12 is greater than the bearing capacity of the tapered annular platform 12, the water current will overflow, and flows downwards from the tapered annular platform 12, and thus this process is a process of flowing along the tapered annular platform 12 while flowing downwards from the tapered annular platform 12, so as to complete distribution of the water current on the surface of the pool 11; and the first transverse direction 119 is opposite to the second transverse direction 113.

Preferably, a third shunt cone 116 is further formed on the slot flush nozzle 111, the third shunt cone 116 is located between the first choke shunt cone 118 and the second choke shunt cone 114 to re-shunt downward water currents shunted by the first choke shunt cone 118 and the second choke shunt cone 114, and shunts are divided into water currents in two inclined down directions: a first inclined direction 117 and a second inclined direction 115.

Figure 3:
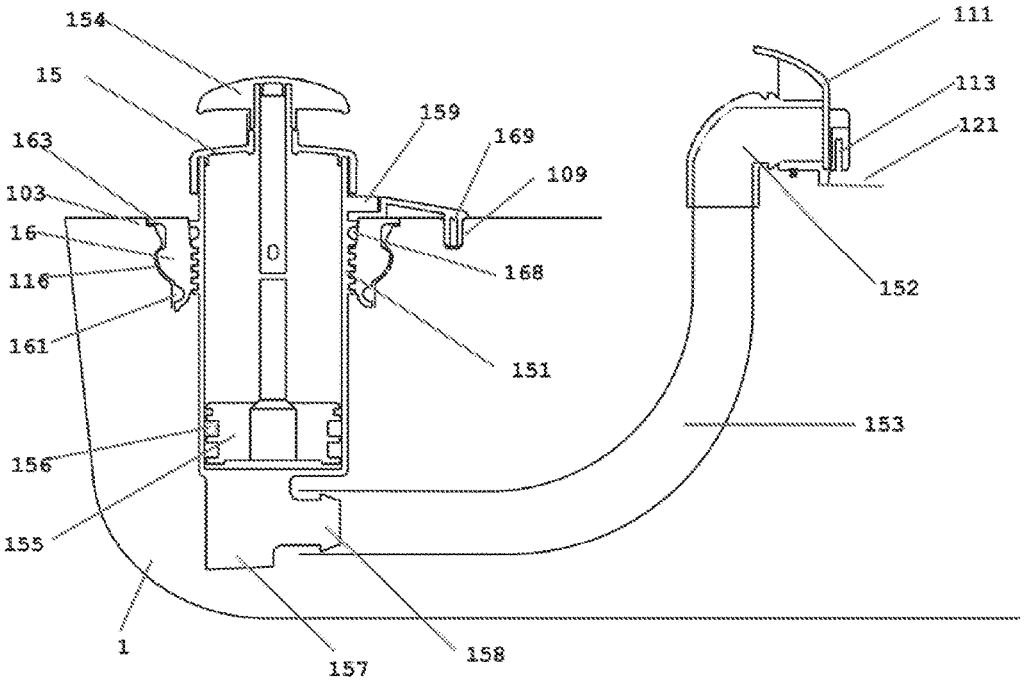
FIG. 3 is a schematic structural diagram of the manual supply means according to the present invention.

As shown in FIG. 3, preferably, the clean water supply means is a manual supply means or an electric supply means or an integration of a manual supply means and an electric supply means, the manual supply means includes: a first pipeline 153 and a piston pressure pump 154, the piston pressure pump 154 is installed onto the toilet pool 1, the piston pressure pump sucks up the clean water in the receiving cavity 10 through a water inlet 157 of the piston pressure pump and supplies clean water to the slot flush nozzle 111 by means of the first pipeline 153 connected with a water outlet 158 of the piston pressure pump 154, and the water inlet 157 is provided with a one-way inlet valve.

This embodiment lists a specific piston pressure pump herein, the piston pressure pump mainly consists of a cylinder 151, a handle 154, a piston 155 and a cylinder end cover 15, the cylinder end cover 15 is detachably connected to an open end of the cylinder 151, the piston 155 is located in the cylinder 151, the handle 154 passes through the cylinder end cover 15 and its bottom end is fixed to the piston 155; preferably, an annular slot for receiving an O-shaped ring 156 is formed on a circumferential surface of the piston 155, and it can be understood that the protection scope of the present application should not be merely limited to such a piston pressure pump listed in this embodiment.

Figure 4:
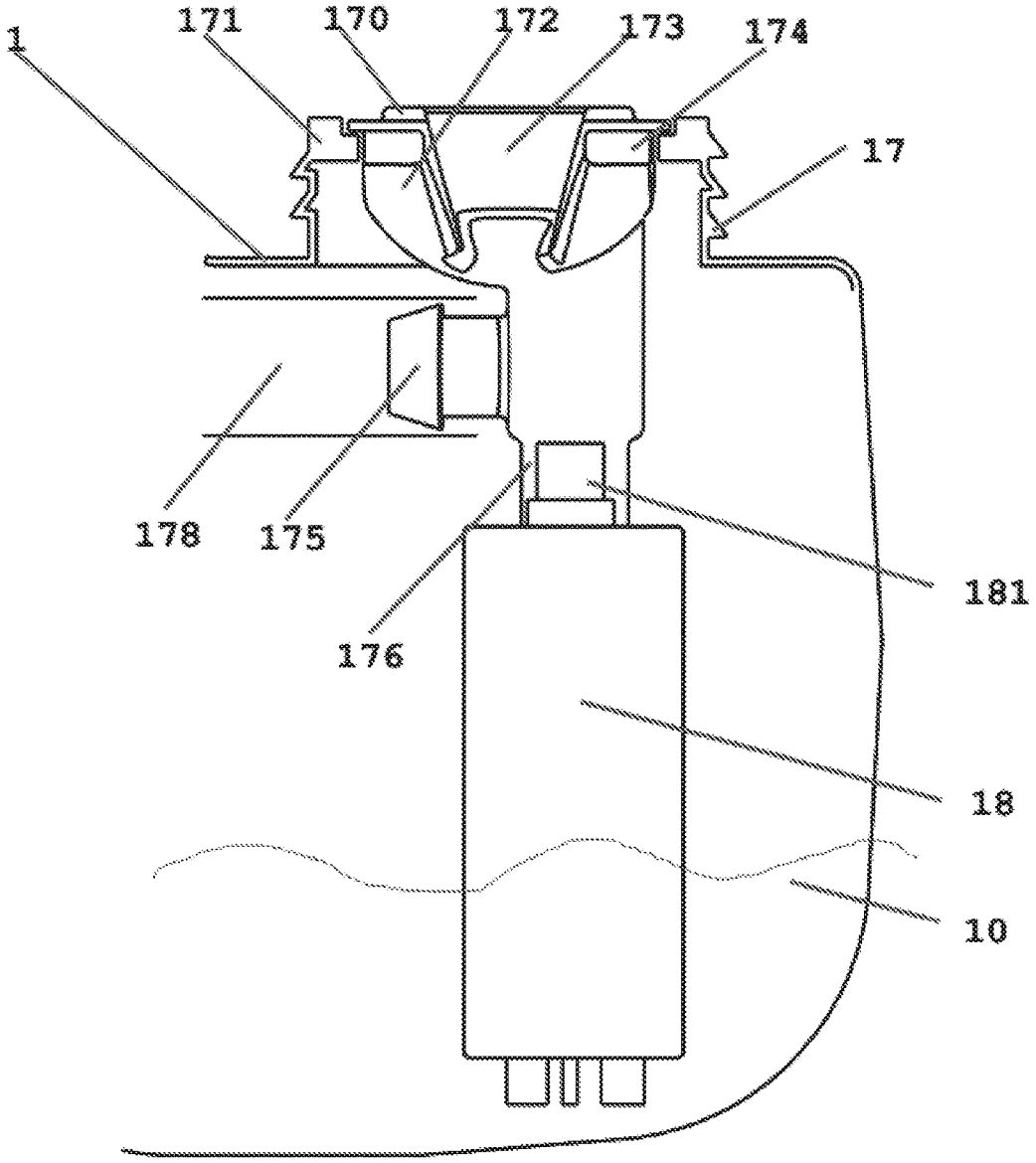
FIG. 4 is a schematic structural diagram of the electric supply means according to the present invention.

As shown in FIG. 4, the electric supply means includes: a sinking pump 18 for pumping out the clean water in the receiving cavity 10 and a second pipeline 178, and the sinking pump 18 supplies clean water to the slot flush nozzle 111 by means of the second pipeline 178.

As shown in FIG. 3, preferably, the manual supply means further includes a nut 16, a first groove 116 is formed on the toilet pool 1, a first projection is formed in a corresponding position of the nut 16, the toilet pool 1 and the nut 16 are rotatably connected together through mutual snapping of the first groove 116 and the first projection, external threads are formed on outer wall surfaces of a cylinder 151 of the piston pressure pump, the cylinder 151 is in a threaded connection with the nut 16, a first seal ring 161 is disposed between the nut 16 and the toilet pool 1, and a second seal ring 168 is disposed between the cylinder 151 and the nut 16.

Optionally, the first seal ring 161 is preferably disposed below the first groove 116, and the second seal ring 168 is preferably disposed above a position where the cylinder 151 is in a threaded connection with the nut 16.

As shown in FIG. 3, preferably, the manual supply means further includes a first anti-loosening means for preventing the nut 16 from loosening and a positioning means for preventing the cylinder 151 from rotating, the first anti-loosening means is connected with the nut 16 and the toilet pool 1, the positioning means mainly consists of a positioning wedge 169 and a connecting arm 159, the positioning wedge 169 is fixed with the cylinder 151 through the connecting arm 159, a pit 109 fitting the positioning wedge 169 is formed on the toilet pool 1, and the positioning wedge 169 penetrates the pit 109.

Preferably, the first anti-loosening means may be implemented by the following components: the first anti-loosening means consists of a ratchet wheel 163 fixed to the circumferential surface of the nut 16 and a pawl 103 installed on the toilet pool 1, the pawl 103 and the ratchet wheel 163 form a ratchet wheel mechanism, the ratchet wheel mechanism enables the nut 16 only to rotate to a screwing direction, so that the nut 16 can be prevented from gradually loosening during use after being screwed; further, the pawl 103 and the ratchet wheel 163 can be fully disconnected in a manual manner, such a means of enabling the pawl 103 and the ratchet wheel 163 to be fully disconnected may adopt some existing implementation means (e.g., the pawl 103 can be lifted relative to the ratchet wheel 163 through manual drawing so as to be fully disconnected from the ratchet wheel 163), and thus the embodiment of the present invention makes no limitation thereto. The purpose of such design is facilitating removal of the nut 16 and ensuring that the nut 16 does not loosen without manual intervention. It can be understood that the protection scope of the present application should not be merely limited to such a first anti-loosening means limited in this embodiment. The piston pressure pump can be firmly fixed to the toilet pool 1 by rotating the nut 16.

Figure 12:
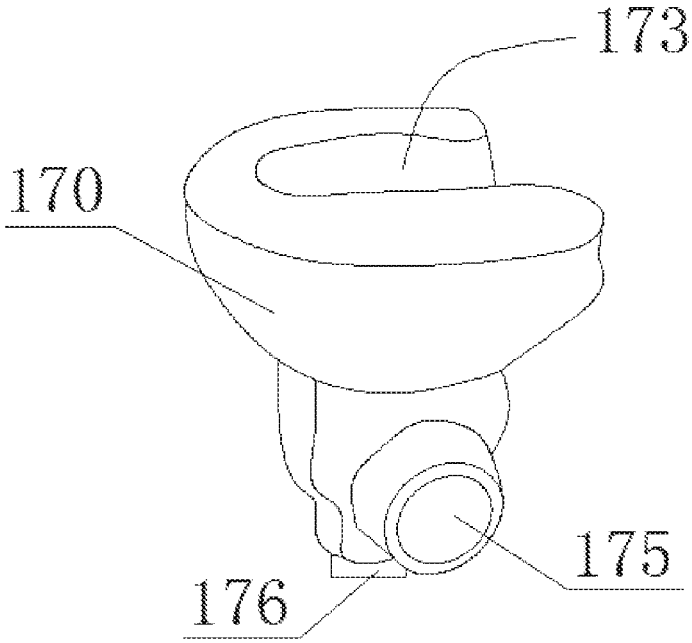
FIG. 12 is a three-dimensional schematic structural diagram of the transitional connector according to the present invention.

As shown in FIG. 4 and FIG. 12, preferably, the toilet pool 1 is provided with a filling port 17 for making up water into the receiving cavity 10, the filling port 17 is provided with a transitional connector 170 having a cavity 172, a top outside face of the transitional connector 170 is recessed downwards to form a filling channel 173 for adding water, the filling channel 173 is in communication with a top opening of the filling port 17 and the receiving cavity 10, equivalent to that the transitional connector 170 blocks a part of the top opening of the filling port 17 and the other part not blocked is the top of the filling channel 173, a filling port inner ring 171 is formed on a top inside of the filling port 17, the transitional connector 170 has a concave nip 174 fitting the filling port inner ring 171, through matching positioning of the filling port inner ring 171 and the concave nip 174, the transitional connector 170 is detachably connected with the filling port 17, a water outlet joint 181 of the sinking pump 18 is connected with a water inlet end 176 of the transitional connector 170, one end of the second pipeline 178 is connected with a water outlet end 175 of the transitional connector 170, the filling channel 173 is not in communication with the cavity 172, and the water inlet end 176 and the water outlet end 175 of the transitional connector 170 are in communication with the cavity 172.

The second pipeline 178 can be in communication with the first pipeline 178 through, for example, a three-way valve, and the tail end of the first pipeline 178 may be connected with an elbow 152, so as to supply water for the slot flush nozzle 111 through the flush nozzle.

Figure 5:
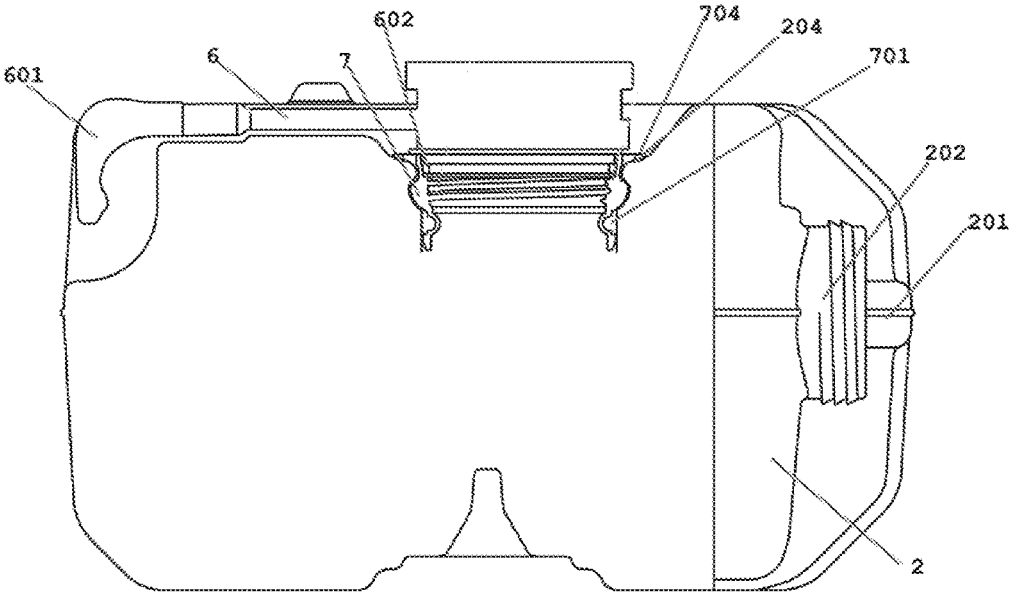
FIG. 5 is a sectional schematic structural diagram of the drain tank according to the present invention.
Figure 6:
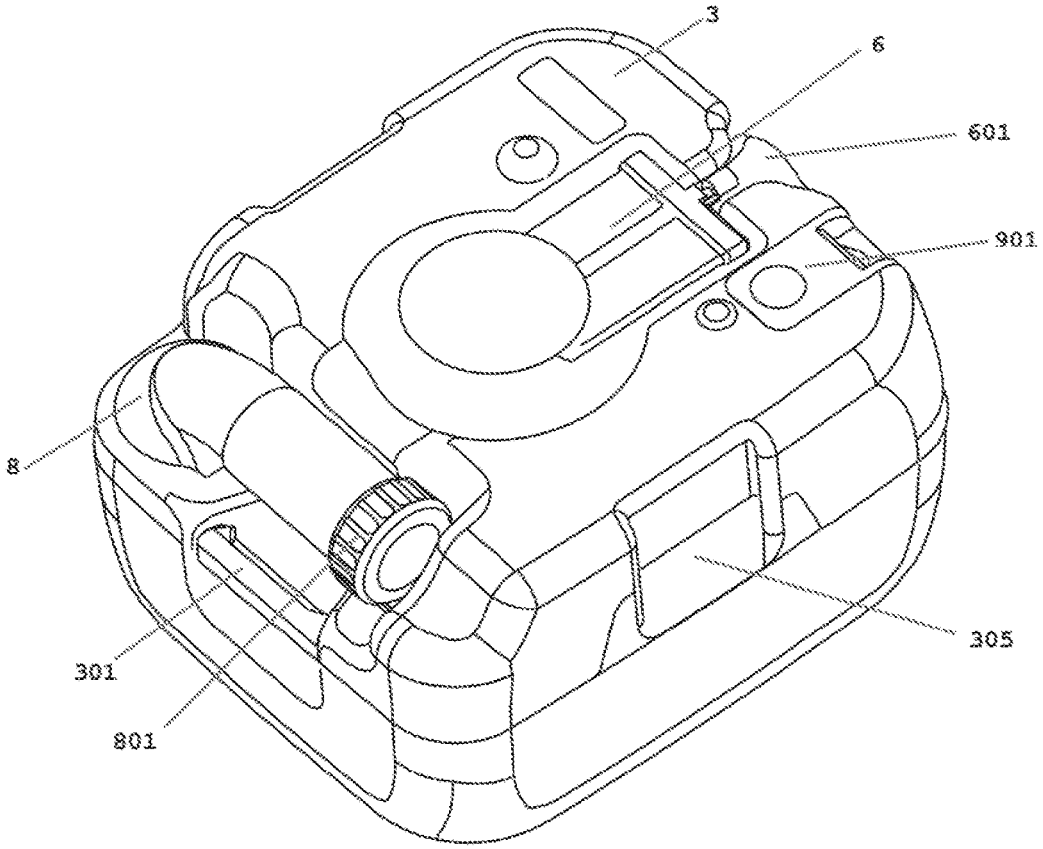
FIG. 6 is a three-dimensional schematic structural diagram of the drain tank according to the present invention.

As shown in FIG. 5 and FIG. 6, preferably, the portable slot water-injection toilet further includes a drain tank 2 for containing sewage, the top of the drain tank 2 is installed with an embedded valve lock nut 7 in a rotating connection with the drain tank 2 and a threaded seal valve 6 in a threaded connection with the embedded valve lock nut 7, the threaded seal valve 6 is in communication with the discharge outlet 14, a second groove is formed on the drain tank 2, a second projection is formed in a corresponding position of the embedded valve lock nut 7, the embedded valve lock nut 7 and the drain tank 2 are snapped together through the second groove and the second projection, a third seal ring 701 is disposed between the embedded valve lock nut 7 and the drain tank 2, a fourth seal ring 602 is disposed between the threaded seal valve 6 and the embedded valve lock nut 7, a position where the drain tank 2 joins the embedded valve lock nut 7 is formed hollowly towards an inner cavity direction of the drain tank 2 to cause the threaded seal valve 6 to sink into the drain tank 2, and the drain tank 2 is provided thereon with a fixed drain outlet 202 and/or a drain pipe 8 in a rotating connection with the drain tank 2.

It can be understood that the tail end of the drain pipe 8 is detachably connected with a cover body 801, and the threaded seal valve 6 has a specialized self-drooping handle 601. It should be noted herein that the threaded seal valve 6 sinking into the drain tank 2 refers to that the top surface of the threaded seal valve 6 is basically flush with the top surface of the drain tank 2, and the advantage thereof is better making use of space, to make the overall structure more intensified and implement capacity maximization with the use of the same space as a whole.

Further, a second anti-loosening means for preventing the embedded valve lock nut 7 from loosening is disposed between the embedded valve lock nut 7 and the drain tank 2.

Preferably, the second anti-loosening means may be implemented by the following components: the second anti-loosening means consists of an external gear 704 fixedly connected onto a circumferential surface of the embedded valve lock nut 7 and an internal gear 204 installed on the drain tank 2, and the external gear 704 and the internal gear 204 are engaged with each other and can be disengaged from each other. The purpose of such design is facilitating removal of the embedded valve lock nut 7 and ensuring that the embedded valve lock nut 7 does not loosen without manual intervention. It can be understood that the protection scope of the present application should not be merely limited to such a second anti-loosening means limited in this embodiment. The second anti-loosening means may also use the components of the first anti-loosening means, and likewise, the first anti-loosening means may also use the components of the second anti-loosening means.

Figure 7:
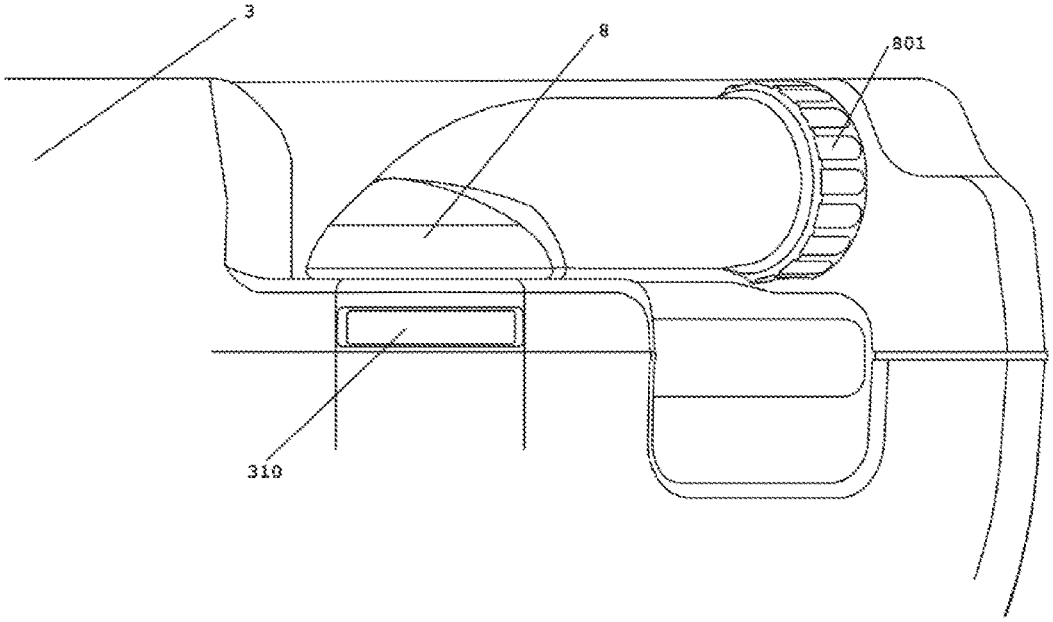
FIG. 7 is a schematic structural diagram of a joint part between the discharge pipe and the drain tank according to the present invention.
Figure 8:
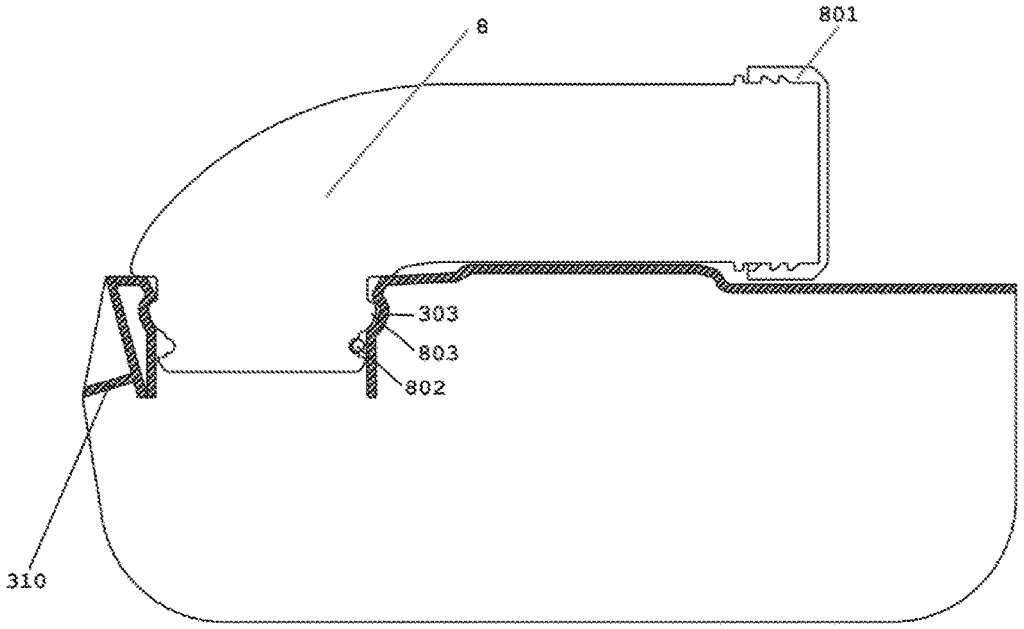
FIG. 8 is a sectional schematic structural diagram of a joint part between the discharge pipe and the drain tank according to the present invention.

As shown in FIG. 7 and FIG. 8, further, a third groove 303 is formed on the drain tank 2, a third projection 803 is formed in a corresponding position on an outer wall side of the drain pipe 8, the drain pipe 8 and the drain tank 2 are snapped together through the third groove 303 and the third projection 803, a fifth seal ring 802 is disposed between the drain pipe 8 and the drain tank 2, a part of the drain pipe 8 extends into the drain tank 2, a slope structure 310 is disposed in an inlet position near the drain pipe 8 on an inner wall face of the drain tank 2, and the highest point of the slope structure 310 is flush with an inlet of the drain pipe 8, the "flush with" herein may be understood as basically flush with, which allows it to be slightly higher or lower in an appropriate amount. As shown in FIG. 8, if there is no slope structure 310, as a part of the drain pipe extends into the drain tank, sewage will always be accumulated in a region sandwiched between the extending portion and the drain tank, and cannot be discharged completely, while, through the slope structure 310, as shown in FIG. 8, the drain tank is rotated 90 degrees counterclockwise at first and then is rotated 90 degrees counterclockwise after most of the sewage is discharged, so the sewage can be discharged completely through the slope structure 310, which avoids sewage accumulation.

Figure 9:
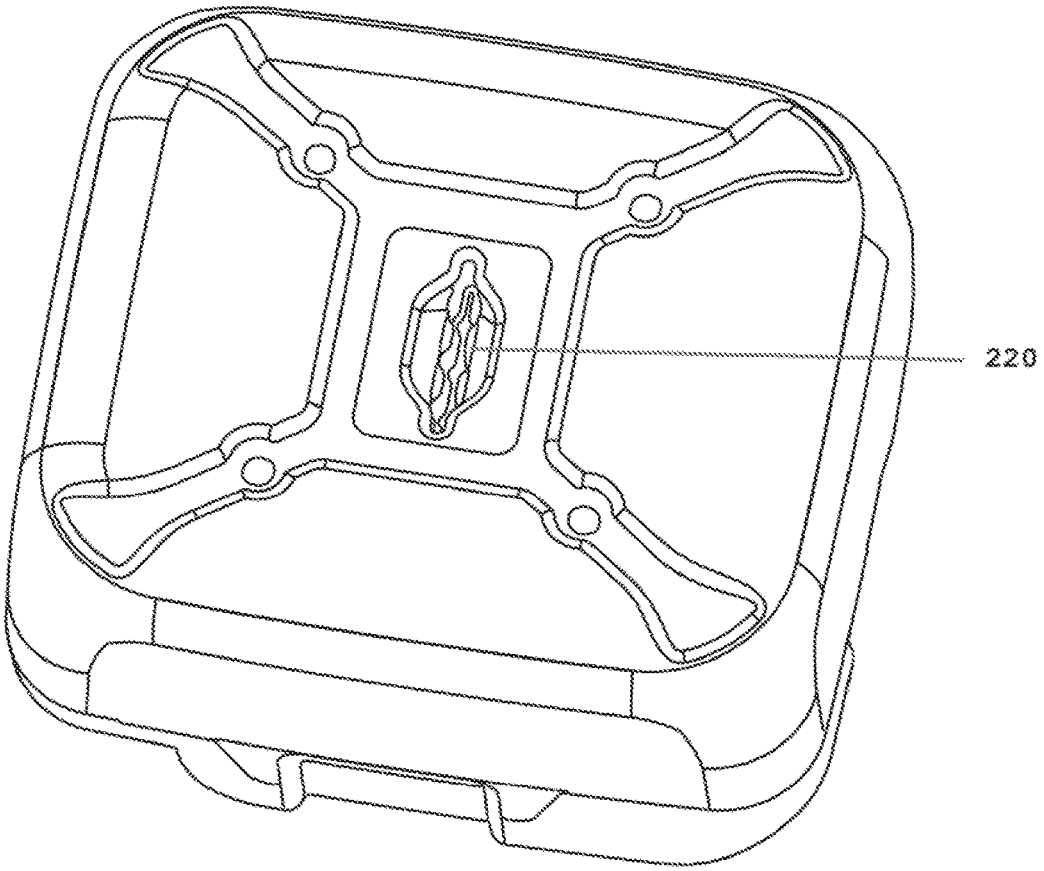
FIG. 9 is a schematic structural diagram of the bottom of the drain tank according to the present invention.

As shown in FIG. 9, the bottom of the drain tank 2 has a long-slit locating slot 220, and inside the long-slit locating slot 220 is a clamping structure for clamping any sheet-like fixed plate or U-shaped reinforcing steel that can be inserted into the long-slit locating slot 220; the sheet-like fixed plate or U-shaped reinforcing steel is fixed onto a fixed substrate, so as to facilitate fixing of the drain tank 2.

Figure 10:
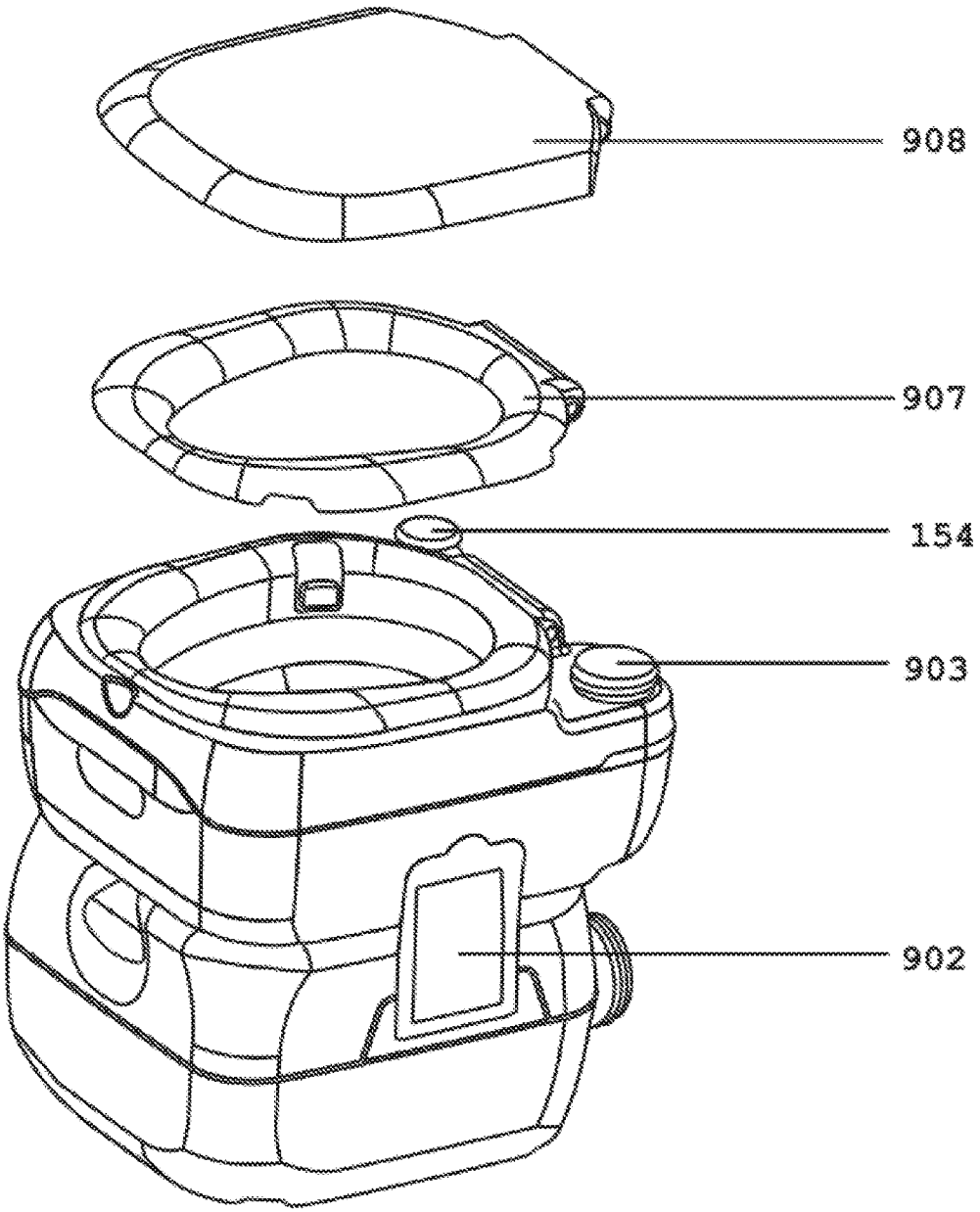
FIG. 10 is an exploded schematic structural diagram of the present invention.
Figure 11:
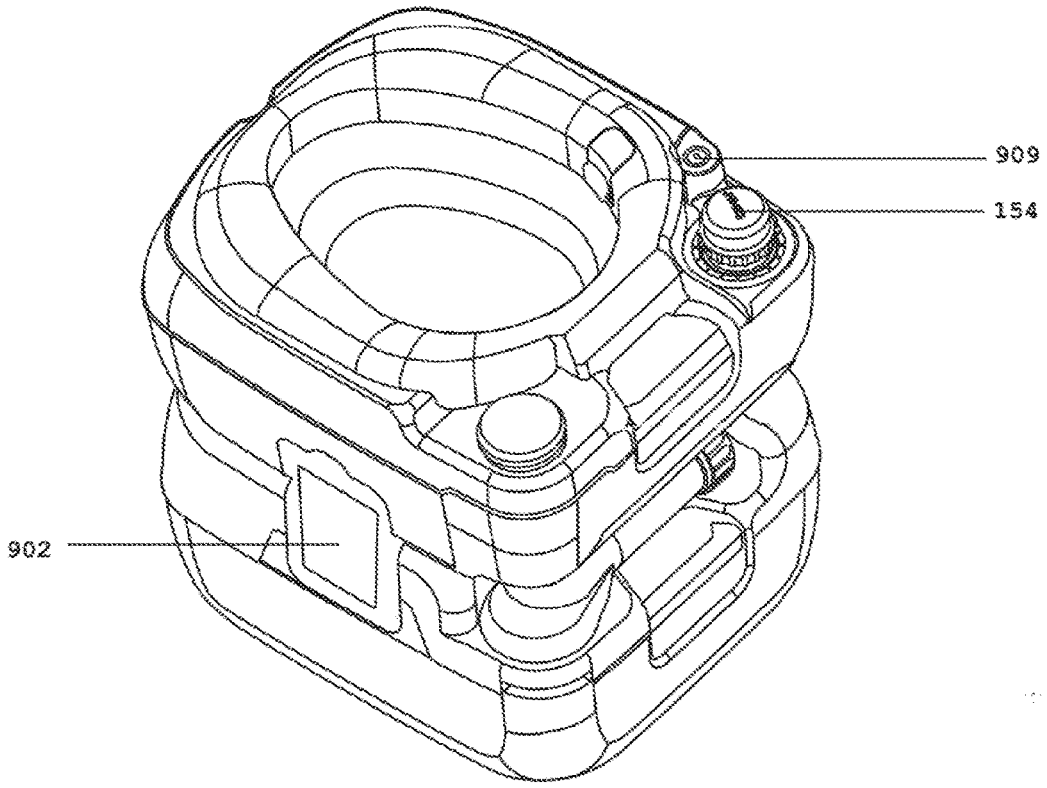
FIG. 11 is a three-dimensional schematic structural diagram of the present invention.

It can be understood that, as shown in FIG. 10 and FIG. 11, according to actual requirements, the portable slot water-injection toilet may further include: a seat ring 907, a seat cover 908 and an edge buckle 902, the drain tank 2 and the toilet pool 1 are detachably connected together by taking a locating wedge 909 as a locating basis and through the edge buckle 902, the drain tank 2 may be provided thereon with fixed handles 201 and 310 shaped once through blow molding, and the filling port 17 is provided with a cover hat 903.

Preferably, the drain tank 2 is provided thereon with an embedded block structure 305 adopted to increase capacity.

Preferably, the drain tank 2 is provided thereon with an expanded exhaust button and a liquid level display device 901.

Figure 13:
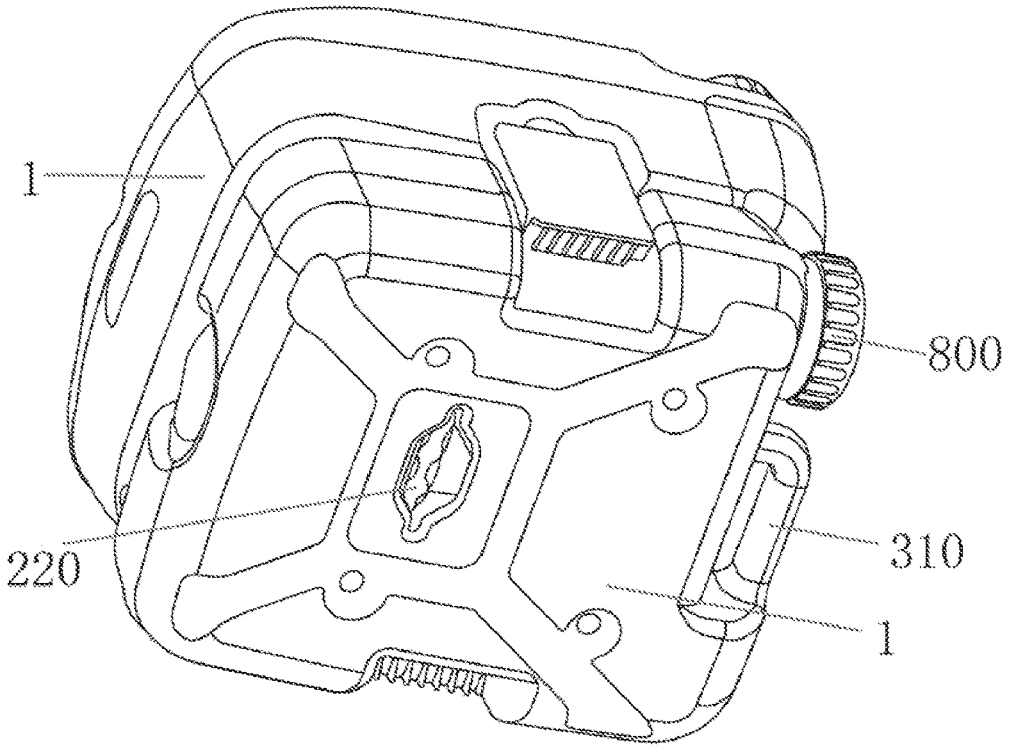
FIG. 13 is a three-dimensional schematic structural diagram of a lower drain tank.

As shown in FIG. 13, an optional configuration is as follows: the drain tank 2 is a lower drain tank, and may be provided thereon with a drain tank cover 800 and a fixed handle 310, and the bottom thereof is provided with a long-slit locating slot 220.

The above description about the disclosed embodiments enables those skilled in the art to implement or use the present invention. Many kinds of modifications to the embodiments will be obvious for those skilled in the art, and the general principle defined herein can be implemented in other embodiments without departing from the principle or scope of the present invention. Therefore, the present invention will not be limited to the embodiments shown herein, but will fall within the broadest scope consistent with the principle and novel characteristics disclosed herein.

What is claimed is:

1. A portable slot water-injection toilet, comprising: a toilet pool having a receiving cavity for receiving clean water, wherein the toilet pool has a pool tapered from top to bottom, a bottom of the pool is a discharge outlet, a top of the pool is a tapered annular platform, the tapered annular platform consists of a wide part and a narrow part, above the tapered annular platform is a slot flush nozzle for shunting a plurality of water currents, a plurality of shunts implemented by the slot flush nozzle are evenly distributed on a surface of the pool under a guide of the tapered annular platform, and the toilet pool is further provided with a clean water supply means, the clean water supply means can supply clean water in the receiving cavity to the slot flush nozzle, wherein the clean water supply means is a manual supply means or an electric supply means or an integration of the manual supply means and the electric supply means, the manual supply means comprises: a first pipeline and a piston pressure pump, the piston pressure pump is installed onto the toilet pool, the piston pressure pump sucks up the clean water in the receiving cavity through a water inlet of the piston pressure pump and supplies the clean water to the slot flush nozzle by means of the first pipeline connected with a water outlet of the piston pressure pump, and the water inlet is provided with a one-way inlet valve; and the electric supply means comprises: a sinking pump for pumping out the clean water in the receiving cavity and a second pipeline, and the sinking pump supplies the clean water to the slot flush nozzle by means of the second pipeline, and wherein the manual supply means further comprises a nut, a first groove formed on the toilet pool, a first projection formed in a corresponding position of the nut, the toilet pool and the nut are rotatably connected together through a mutual snapping of the first groove and the first projection, a plurality of external threads are formed on an outer wall surface of a cylinder of the piston pressure pump, the cylinder is in a threaded connection with the nut, a first seal ring is disposed between the nut and the toilet pool, and a second seal ring is disposed between the cylinder and the nut.

2. The portable slot water-injection toilet according to claim 1, wherein a first choke shunt cone and a second choke shunt cone are formed on the slot flush nozzle, and the first choke shunt cone and the second choke shunt cone shunt the plurality of water currents of a nozzle water inlet, a part of a first shunt shunted by the first choke shunt cone flows from the wide part of the tapered annular platform to the narrow part of the tapered annular platform along a first transverse direction, and an other part of the first shunt shunted by the first choke shunt cone flows down along a surface of the pool like a fan along a downward direction; a part of a second shunt shunted by the second choke shunt cone flows from the wide part of the tapered annular platform to the narrow part of the tapered annular platform along a second transverse direction, and an other part of the second shunt shunted by the second choke shunt cone flows down along the surface of the pool like the fan along the downward direction; and the first transverse direction is opposite to the second transverse direction.

3. The portable slot water-injection toilet according to claim 2, wherein a third shunt cone is further formed on the slot flush nozzle, the third shunt cone is located between the first choke shunt cone and the second choke shunt cone to re-shunt downward the plurality of water currents shunted by the first choke shunt cone and the second choke shunt cone, and the plurality of shunts are divided into the plurality of water currents in two inclined down directions: a first inclined direction and a second inclined direction.

4. The portable slot water-injection toilet according to claim 3, wherein the portable slot water-injection toilet further comprises a drain tank for containing sewage, a top of the drain tank is installed with an embedded valve lock nut in a rotating connection with the drain tank and a threaded seal valve in a threaded connection with the embedded valve lock nut, the threaded seal valve is in a communication with the discharge outlet, a second groove is formed on the drain tank, a second projection is formed in a corresponding position of the embedded valve lock nut, the embedded valve lock nut and the drain tank are snapped together through the second groove and the second projection, a third seal ring is disposed between the embedded valve lock nut and the drain tank, a fourth seal ring is disposed between the threaded seal valve and the embedded valve lock nut, a position where the drain tank joins the embedded valve lock nut is formed hollowly towards an inner cavity direction of the drain tank to cause the threaded seal valve to sink into the drain tank, and the drain tank is provided thereon with a fixed drain outlet and/or a drain pipe in a rotating connection with the drain tank.

5. The portable slot water-injection toilet according to claim 2, wherein the portable slot water-injection toilet further comprises a drain tank for containing sewage, a top of the drain tank is installed with an embedded valve lock nut in a rotating connection with the drain tank and a threaded seal valve in a threaded connection with the embedded valve lock nut, the threaded seal valve is in a communication with the discharge outlet, a second groove is formed on the drain tank, a second projection is formed in a corresponding position of the embedded valve lock nut, the embedded valve lock nut and the drain tank are snapped together through the second groove and the second projection, a third seal ring is disposed between the embedded valve lock nut and the drain tank, a fourth seal ring is disposed between the threaded seal valve and the embedded valve lock nut, a position where the drain tank joins the embedded valve lock nut is formed hollowly towards an inner cavity direction of the drain tank to cause the threaded seal valve to sink into the drain tank, and the drain tank is provided thereon with a fixed drain outlet and/or a drain pipe in a rotating connection with the drain tank.

6. The portable slot water-injection toilet according to claim 1, wherein the manual supply means further comprises a first anti-loosening means for preventing the nut from loosening and a positioning means for preventing the cylinder from rotating, the first anti-loosening means is connected with the nut and the toilet pool, the positioning means includes a positioning wedge and a connecting arm, the positioning wedge is fixed with the cylinder through the connecting arm, a pit fitting the positioning wedge is formed on the toilet pool, and the positioning wedge penetrates the pit.

7. The portable slot water-injection toilet according to claim 1, wherein the toilet pool is provided with a filling port for adding water into the receiving cavity, the filling port is provided with a transitional connector having a cavity, a top outside face of the transitional connector is recessed downwards to form a filling channel for adding water, the filling channel is in a communication with a top opening of the filling port and the receiving cavity, a filling port inner ring is formed on a top inside of the filling port, the transitional connector has a concave nip fitting the filling port inner ring, through matching positioning of the filling port inner ring and the concave nip, the transitional connector is detachably connected with the filling port, a water outlet joint of the sinking pump is connected with a water inlet end of the transitional connector, one end of the second pipeline is connected with a water outlet end of the transitional connector, the filling channel is not in a communication with the cavity, and the water inlet end and the water outlet end of the transitional connector are in the communication with the cavity.

8. The portable slot water-injection toilet according to claim 1, wherein the portable slot water-injection toilet further comprises a drain tank for containing sewage, a top of the drain tank is installed with an embedded valve lock nut in a rotating connection with the drain tank and a threaded seal valve in a threaded connection with the embedded valve lock nut, the threaded seal valve is in a communication with the discharge outlet, a second groove is formed on the drain tank, a second projection is formed in a corresponding position of the embedded valve lock nut, the embedded valve lock nut and the drain tank are snapped together through the second groove and the second projection, a third seal ring is disposed between the embedded valve lock nut and the drain tank, a fourth seal ring is disposed between the threaded seal valve and the embedded valve lock nut, a position where the drain tank joins the embedded valve lock nut is formed hollowly towards an inner cavity direction of the drain tank to cause the threaded seal valve to sink into the drain tank, and the drain tank is provided thereon with a fixed drain outlet and/or a drain pipe in a rotating connection with the drain tank.

9. The portable slot water-injection toilet according to claim 8, wherein a second anti-loosening means for preventing the embedded valve lock nut from loosening is disposed between the embedded valve lock nut and the drain tank.

10. The portable slot water-injection toilet according to claim 9, wherein a third groove is formed on the drain tank, a third projection is formed in a corresponding position on an outer wall side of the drain pipe, the drain pipe and the drain tank are snapped together through the third groove and the third projection, a fifth seal ring is disposed between the drain pipe and the drain tank, a part of the drain pipe extends into the drain tank, a slope structure is disposed in an inlet position near the drain pipe on an inner wall face of the drain tank, and the highest point of the slope structure is flush with an inlet of the drain pipe.

11. The portable slot water-injection toilet according to claim 8, wherein a bottom of the drain tank has a long-slit locating slot, and inside the long-slit locating slot is a clamping structure for clamping each sheet-like fixed plate or U-shaped reinforcing steel, and the sheet-like fixed plate or the U-shaped reinforcing steel can be inserted into the long-slit locating slot.

* * * * *